US008338357B2

(12) United States Patent
Gibis et al.

(10) Patent No.: US 8,338,357 B2
(45) Date of Patent: Dec. 25, 2012

(54) MULTIPLE DOSING WARE WASHING ARTICLE

(75) Inventors: Karl Ludwig Gibis, Limburgerhof (DE); Chris Efstathios Housmekerides, Ludwigshafen (DE); Rainer Link, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 13/182,520

(22) Filed: Jul. 14, 2011

(65) Prior Publication Data

US 2011/0265828 A1 Nov. 3, 2011

Related U.S. Application Data

(62) Division of application No. 12/160,902, filed as application No. PCT/GB2007/000175 on Jan. 19, 2007, now abandoned.

(30) Foreign Application Priority Data

Jan. 21, 2006 (GB) ..... 0601247.0
Oct. 30, 2006 (GB) ..... 0621580.0

(51) Int. Cl.
*C11D 17/04* (2006.01)
*C11D 11/00* (2006.01)
*B08B 9/20* (2006.01)

(52) U.S. Cl. ..... 510/439; 510/224; 510/445; 510/446; 134/25.2

(58) Field of Classification Search ..... 510/439, 510/224, 293, 298, 445, 446; 134/25.2
See application file for complete search history.

(56) References Cited

U.S. PATENT DOCUMENTS

| | | | |
|---|---|---|---|
| 2,370,609 | A | 2/1945 | Wilson |
| 2,514,000 | A | 7/1950 | Kent |
| 2,777,570 | A | 1/1957 | Mytinger |
| 2,880,077 | A | 3/1959 | Floria |
| 2,954,145 | A | 9/1960 | McCauley |
| 3,063,459 | A | 11/1962 | Jacobs |
| 3,091,402 | A | 5/1963 | Palmer |
| 3,187,767 | A | 6/1965 | Sheppard |
| 3,198,010 | A | 8/1965 | Huston |
| 3,272,899 | A | 9/1966 | Diamond et al. |
| 3,411,671 | A | 11/1968 | Harvey et al. |
| 3,482,740 | A | 12/1969 | Evans et al. |

(Continued)

FOREIGN PATENT DOCUMENTS

CA 2235889 A1 10/1999

(Continued)

OTHER PUBLICATIONS

English Language Abstract for EP0863200 taken from esp@cenet.com.

(Continued)

*Primary Examiner* — Lorna M Douyon
(74) *Attorney, Agent, or Firm* — Norris McLaughlin & Marcus PA

(57) ABSTRACT

An article comprises a rack of solid sticks (12) of dishwasher detergent, retained on a backing material (16) and being formable into a nested, preferably cylindrical, form. The nested article is inserted into a holder, which is a plastics body, rigid and substantial. The holder is a permanent article located in use in a dishwasher but the article is a refill. Wastage of material when it is exhausted is minimal.

9 Claims, 3 Drawing Sheets

U.S. PATENT DOCUMENTS 3,494,436 A 2/1970 Lanning
3,688,795 A 9/1972 Taylor
3,759,284 A 9/1973 Crowley et al.
3,822,561 A 7/1974 Miller
4,055,278 A 10/1977 Seymour
D269,801 S 7/1983 Sangster et al.
4,416,859 A 11/1983 Brown et al.
D273,033 S 3/1984 Sangster et al.
4,436,269 A 3/1984 Dirksing
D280,757 S 9/1985 Paulovich et al.
4,700,554 A 10/1987 Eichman et al.
4,707,866 A 11/1987 Von Philipp et al.
4,835,804 A 6/1989 Arnau-Munoz et al.
D304,102 S 10/1989 Lakhan et al.
4,917,272 A 4/1990 Ikeda
D308,739 S 6/1990 Nystuen
4,999,124 A 3/1991 Copeland
5,033,643 A 7/1991 Schumacher
5,088,517 A 2/1992 Bersch
D328,332 S 7/1992 Fink
D328,333 S 7/1992 Casberg
5,137,694 A 8/1992 Copeland
5,194,230 A 3/1993 PeKarna
5,251,777 A 10/1993 McMahon
5,262,132 A 11/1993 Bricker et al.
D346,890 S 5/1994 Panesar
5,310,060 A 5/1994 Bitner et al.
5,310,430 A 5/1994 McCall, Jr.
5,474,211 A 12/1995 Hellenberg
5,500,050 A 3/1996 Chan et al.
5,549,074 A 8/1996 Hui
D376,320 S 12/1996 Lathrop et al.
5,603,233 A 2/1997 Erickson et al.
D381,141 S 7/1997 Balz
5,643,591 A 7/1997 Mehra et al.
D383,264 S 9/1997 Balz
5,679,173 A 10/1997 Hartman
5,681,400 A 10/1997 Brady et al.
5,685,178 A 11/1997 Ahn
5,785,180 A 7/1998 Dressel et al.
5,830,576 A 11/1998 Mehra et al.
5,870,906 A 2/1999 Denisar
5,967,158 A 10/1999 Smith et al.
5,971,154 A 10/1999 Toren
6,048,501 A 4/2000 Lemaire et al.
6,058,946 A 5/2000 Bellati et al.
6,173,743 B1 1/2001 Ibanez Sapina
6,178,987 B1 1/2001 Caruthers, Jr. et al.
6,263,708 B1 7/2001 Yarmosky
6,375,038 B1 4/2002 Daansen et al.
6,375,956 B1 * 4/2002 Hermelin et al. ..... 424/400
D457,596 S 5/2002 Guzman et al.
6,463,766 B2 10/2002 Kubota et al.
D465,258 S 11/2002 Hiranaga et al.
6,540,081 B2 4/2003 Balz et al.
6,571,993 B2 6/2003 Rodd et al.
6,576,599 B1 6/2003 Stone
6,581,800 B2 6/2003 Rodd et al.
6,589,925 B1 7/2003 Binstock et al.
6,608,022 B1 8/2003 Zabarylo et al.
D481,844 S 11/2003 Greene et al.
6,681,963 B2 1/2004 Hague et al.
D513,928 S 1/2006 Birdsell et al.
D526,043 S 8/2006 Thompson
D529,128 S 9/2006 Lee
7,156,353 B2 1/2007 Kringel
7,188,521 B2 3/2007 Fling
D539,993 S 4/2007 Brandt
7,219,518 B2 5/2007 Aouad et al.
D547,912 S 7/2007 Brandt
7,276,470 B2 10/2007 Hahn
D564,141 S 3/2008 Gaa et al.
D564,142 S 3/2008 Gaa et al.
D564,143 S 3/2008 Gaa et al.
D568,555 S 5/2008 Gaa et al.
7,421,867 B2 9/2008 Bongini
7,428,831 B2 9/2008 Cho et al.
D601,766 S 10/2009 Gaa et al.
D604,466 S 11/2009 Gaa et al.
D608,960 S 1/2010 Gaa et al.
2001/0010165 A1 8/2001 Kubota et al.
2002/0004472 A1 1/2002 Holderbaum et al.
2002/0169092 A1 11/2002 Catlin et al.
2003/0052138 A1 3/2003 Smith
2003/0168085 A1 9/2003 Sowle et al.
2003/0182732 A1 10/2003 Davenet et al.
2004/0011693 A1 1/2004 Prenger et al.
2004/0053808 A1 3/2004 Raehse et al.
2004/0206133 A1 10/2004 Woo et al.
2004/0216499 A1 11/2004 Bongini
2004/0217125 A1 11/2004 Marone
2005/0023290 A1 2/2005 Kon et al.
2005/0039781 A1 2/2005 Song et al.
2005/0121058 A1 6/2005 Furber et al.
2005/0139241 A1 6/2005 Jowett et al.
2005/0235704 A1 10/2005 Cho et al.
2006/0258556 A1 11/2006 Holderbaum et al.
2007/0000068 A1 1/2007 Gerard France et al.
2007/0295036 A1 12/2007 Brandt et al.
2008/0053187 A1 3/2008 Koring
2008/0053494 A1 3/2008 Moro et al.

FOREIGN PATENT DOCUMENTS

CA 2313356 A1 1/2001
DE 2244722 10/1973
DE 3513640 A1 10/1986
DE 8814550 U1 1/1989
DE 4400417 A1 7/1995
DE 19516312 C1 8/1996
DE 19540608 A1 5/1997
DE 19652733 A1 6/1998
DE 19740819 A1 3/1999
DE 19836857 A1 2/2000
DE 19930771 A1 1/2001
DE 10044495 A1 10/2002
EP 0391087 A 10/1990
EP 0457137 A1 11/1991
EP 0481547 A1 4/1992
EP 0521179 A1 1/1993
EP 0863200 A 9/1998
EP 0903405 A2 3/1999
EP 0906747 A2 4/1999
FR 2723751 A1 2/1996
FR 2723752 A1 2/1996
GB 820327 9/1959
GB 1142238 2/1969
GB 1198251 7/1970
GB 2037719 A 7/1980
GB 1592357 7/1981
GB 2104109 A 3/1983
GB 2134654 A 8/1984
GB 2244722 A 12/1991
GB 2339678 A 2/2000
GB 2356842 A 6/2001
GB 2386129 A 9/2003
GB 2386130 A 9/2003
GB 2386129 A 10/2003
GB 2386130 A 10/2003
GB 2402604 A 12/2004
GB 2402679 A 12/2004
GB 2406821 A 4/2005
GB 2417492 A 3/2006
JP 1317493 A 12/1989
JP 2000317350 A 11/2000
JP 2003260130 A 9/2003
JP 2006061450 3/2006
JP 2006122196 A 5/2006
KR 950002460 B1 3/1995
SU 838371 A1 6/1981
WO 8806199 A1 8/1988
WO 9712539 A1 4/1997
WO 0107702 A1 2/2001
WO 0107703 A1 2/2001
WO 0178572 A2 10/2001
WO 0220893 A 3/2002
WO 02/051704 A 7/2002
WO 02058528 A1 8/2002

| | | | |
|---|---|---|---|
| WO | 02076278 | A2 | 10/2002 |
| WO | 03073907 | A2 | 3/2003 |
| WO | 03073906 | A1 | 9/2003 |
| WO | 2004/033297 | A2 | 4/2004 |
| WO | 2004033297 | A2 | 4/2004 |
| WO | 2004041248 | A2 | 5/2004 |
| WO | 2004044303 | A1 | 5/2004 |
| WO | 2004059068 | A1 | 7/2004 |
| WO | 2004085595 | A1 | 10/2004 |
| WO | 2005099552 | A2 | 10/2005 |
| WO | 2006000237 | A1 | 1/2006 |
| WO | 2006/021761 | A | 3/2006 |
| WO | 2006021760 | A1 | 3/2006 |
| WO | 2006021761 | A1 | 3/2006 |
| WO | 2006021773 | A1 | 3/2006 |
| WO | 2007051989 | A1 | 5/2007 |
| WO | 2007083142 | A1 | 7/2007 |

OTHER PUBLICATIONS

English Language Abstract for EP0391087 taken from esp@cenet.com.
English Language Abstract for DE10044495 taken from esp@cenet.com.
International Search Report PCT/GB2005/003271, mailed on Nov. 22, 2005.
Written Opinion PCT/GB2005/003271, mailed on Nov. 22, 2005.
Written Opinion PCT/GB2005/003265, mailed on Nov. 22, 2005.
International Search Report PCT/GB2005/003265, mailed on Nov. 22, 2005.
English Translation of application FR 2723751 taken from esp@net.com.
English Translation application DE 19740819 A1 taken from esp@net.com.
English Translation application DE 19516312 C1 taken from esp@net.com.
English Translation of EP 0906747 provided by esp@cenet.com.
English Abstract of JP 2000-317350 taken from espa@cenet.com.
English Abstract of JP 2003-260130 taken from espa@cenet.
English Abstract of JP 2006-122196 taken from espa@cenet.
English Abstract of KR 2002001154 in Office Action dated Oct. 26, 2011 of related U.S. Appl. No. 12/447,509.
English Translation application DE 4400417 taken from esp@cenet.com.
English language translation for DE 3513640 published Oct. 18, 1986.
English language translation for KR 950002460 published Mar. 20, 1995.
English language translation for DE 8814550 published Jan. 19, 1989.

* cited by examiner

MULTIPLE DOSING WARE WASHING ARTICLE

This is a divisional patent application of U.S. Ser. No. 12/160,902 filed on Aug. 19, 2008, now abandoned, which in turn was an application filed under 35 USC 371 of PCT/GB2007/000175 on Jan. 19, 2007.

This invention relates to a article which serves as a refill containing a plurality of dosage elements of cleaning composition, for use in a ware washing machine, for example a dishwashing machine or a laundry washing machine.

In accordance with a first aspect of the present invention there is provided an article comprising a rack of solid dosage elements of a cleaning composition, the rack of dosage elements being retained on a backing material and being formable into a nested form.

The rack may be in the form of a parallel array of elongate solid dosage elements.

The article can be made in flat form, and formed into the nested form, and inserted into a holder, located, or to be located, in a ware washing machine.

Preferably the nested form is generally cylindrical.

Preferably, in the nested form, the backing material is on the outside and so the dosage elements project inwards. However embodiments in which, in the nested form, the backing material is on the inside and so the dosage elements project outwards are not excluded, e.g. a central core of backing material with dosage elements attached thereto and projecting outwards.

Preferably the dosage elements are in the form of rods or sticks, and are held substantially parallel to each other on the backing material.

Preferably the article contains at least 6 dosage elements, more preferably at least 8, and most preferably at least 10.

Preferably the article contains up to 20 dosage elements, more preferably up to 18, and most preferably up to 16.

Preferably the backing material is a sheet or is made up of a series of portions, for example panels, articulated together such that the nested form may be achieved. When the backing material is a sheet the article may be formed into a nested form by rolling it, preferably until one end touches or even overlaps the other end. When the backing material is a series of portions articulated together the article may be formed into a nested form by rolling or folding it, preferably until one end reaches or overlaps the other end.

Preferably the nested form is maintained by securing one part of the backing material to another part; preferably one end to the other end. The securement means may conveniently be adhesive tape or other securing means located so as to prevent unrolling or unfolding of the article, as the case may be.

Preferably there a small gap between dosage elements in the non-nested position so that they can be formed into their nested position without hindrance.

Preferably each dosage element is retained in a sleeve, for example of a plastics material. Alternatively any other suitable material may be used, such as, cardboard-based material (especially covered by a water-resistant material). Laminated cardboard with a suitable laminate is one material which may be used. Each sleeve may have at least one opening to allow the dosage element to be washed away in use. Preferably each sleeve has two openings, at opposite ends so that water may enter one end (the upper end in use) and leave the other end (the lower end in use), carrying with it dissolved or broken away cleaning composition. An upper opening may suitably be of area at least 10 $mm^2$, preferably at least 30 $mm^2$, and most preferably at least 60 $mm^2$. Suitably it may be of area up to 200 $mm^2$, preferably up to 160 $mm^2$, and most preferably up to 120 $mm^2$. The upper face of the sleeve may suitably be left totally open. A lower opening may suitably be of area at least 3 $mm^2$, preferably at least 6 $mm^2$, and most preferably at least 10 $mm^2$. Suitably it may be of area up to 200 $mm^2$, preferably up to 60 $mm^2$, and most preferably up to 20 $mm^2$. The lower face of the sleeve is preferably not left totally open, so that it retains the dosage element in place, until in use it dissolves. There may be one or more intermediate openings in the side face of the sleeve, i.e. between the upper opening and the lower opening, and the size thereof preferably conforms to the definitions given above for the lower opening.

Preferably the sleeves are formed in one piece. That piece may be in the form of a moulded or thermoformed tray having multiple compartments, into which the dosage elements are placed. The backing material may be secured over the tray to entrap the dosage elements. In such an embodiment the tray and backing material together form the sleeves.

The dosage elements are of a solid cleaning composition and as such may be of a particulate material, for example powder or granules, provided that the material is retained until it is washed away in use; for example in a sleeve as described above. Preferably however the dosage elements are of solid cleaning composition in the sense of being non-flowable. Preferably they are of a coherent mass; preferably formed by a moulding or shaping process, for example injection moulding, extrusion, casting or compression forming. Alternatively, the dosage elements may be in the form of a viscous gel or paste, such gel or paste preferably being sufficiently viscous to remain within the container until such time as it is contacted with water to flush it out of the container.

Preferably the dosage elements are identical to each other.

Preferably the dosage elements are of substantially the same cross-section along their length; in particular, they preferably do not taper.

A dosage element of the invention is preferably monolithic but in some embodiments the dosage element is constituted by two or more pieces set end-to-end, able to serve as a single charge of cleaning composition during a washing operation; for example such pieces may be held together end-to-end in a retaining part, for example a sleeve as aforesaid. Such a part may, of course, also hold a monolithic dosage element.

In further defining a preferred, elongate, dosage element we can refer to aspect ratio, by which is meant the ratio or length to width. By width (or thickness) is meant a dimension perpendicular for the length. However such definitions are made potentially complicated by the fact that the dosage element of the invention may not be of regular shape. It could, for example, have one or two slanted ends so that "the length" needs further definition; and/or the cross-section may be irregular, so that "the width" needs further definition. It might be logical to define the length and width in terms of mean values but mean values may be difficult to determine and ultimately could be mathematical constructs rather than practical measures of value to the skilled person.

Having regard to the foregoing comments we have chosen to further define an elongate dosage element using the following parameters: minimum length; maximum width; maximum cross-sectional area (that is, largest area perpendicular to the length); total surface area; and volume. Even if it may be thought that it would be more logical to use mean values, we prefer to use these maximum and minimum parameters, which do not require calculations, just measurement. We thereby ensure that we offer definitions which are practical and testable. All numerical definitions expressed herein are based on such parameters. Thus aspect ratio, for example, is the ratio of minimum length to maximum width.

The following definitions of preferred dosage elements of the invention apply both to elongate dosage elements which are monolithic and to elongate dosage elements constituted by two or more pieces set end-to-end. In the latter embodiments the following definitions treat such dosage elements as if the were monolithic; for example length denotes the consolidated length, and surface area denotes the surface area of the dosage elements set end-to-end, not the summated surface area of the separated pieces.

Preferably the length (that is, the minimum length—see above) of an elongate dosage element is at least 4 cm, preferably at least 5 cm, preferably at least 6 cm.

Preferably the length of an elongate dosage element is up to 14 cm, preferably up to 12 cm, preferably up to 10 cm.

Preferably the thickness (that is, the maximum thickness—see above) of an elongate dosage element is at least 0.8 cm, preferably at least 1.4 cm, preferably at least 1.8 cm.

Preferably the thickness of an elongate dosage element is up to 5 cm, more preferably up to 3.5 cm, more preferably up to 2.5 cm.

Preferably the cross-sectional area (that is, the maximum cross-sectional area—see above) of an elongate dosage element is at least 0.6 $cm^2$, preferably at least 1 $cm^2$, preferably at least 1.5 cm.

Preferably the cross-sectional area of an elongate dosage element is up to 5 $cm^2$, preferably up to 3.5 $cm^2$, more preferably up to 2.5 $cm^2$.

Preferably the surface area of an elongate dosage element is at least 30 $cm^2$, preferably at least 35 $cm^2$, preferably at least 40 $cm^2$.

Preferably the surface area of an elongate dosage element is up to 60 $cm^2$, preferably up to 55 $cm^2$, preferably up to 50 $cm^2$.

Preferably the volume of an elongate dosage element is at least 6 ml, preferably at least 9 ml, preferably at least 12 ml.

Preferably the volume of an elongate dosage element is up to 25 ml, preferably up to 20 ml, preferably up to 16 ml.

Preferably the weight of an elongate dosage element is at least 8 g, preferably at least 12 g, preferably at least 15 g.

Preferably the weight of an elongate dosage element is up to 32 g, preferably up to 26 g, preferably up to 24 g.

Preferably an elongate dosage element has an aspect ratio (that is, the ratio of minimum length to maximum thickness—see above) of at least 2:1, preferably at least 2.5:1, preferably at least 3:1.

Preferably an elongate dosage element has an aspect ratio of up to 12:1, preferably up to 8:1, preferably up to 6:1.

Preferably an elongate dosage element has a ratio of length to cross-sectional area of at least 2:1, preferably at least 2.5:1, preferably at least 3:1 (units of $length^{-1}$).

Preferably an elongate dosage element has a ratio of length to cross-sectional area of up to 12:1, preferably up to 8:1, preferably up to 6:1 (units of $length^{-1}$).

Preferably an elongate dosage element has a ratio of surface area to volume of at least 1.5:1, preferably at least 2:1, preferably at least 3:1 (units of $length^{-1}$).

Preferably an elongate dosage element has a ratio of surface area to volume of up to 8:1, preferably up to 6:1, preferably up to 4:1 (units of $length^{-1}$).

Preferably the article is such that, in its nested form, each pair of dosage elements is separated by a spacing, at least for part of the depth of the dosage elements. The spacing preferably extends part-way towards the backing; for example between one-third and two-thirds of the distance to the backing. The separate holder into which the nested article is placed, in use, preferably has an array of walls radiating from a hub, wherein spacings must be mated with divider walls when the article is located in the holder. There could be one-to-one correspondence between spacings and divider walls, but preferably there are more spacings than divider walls. Three or four divider walls will generally suffice to cause the article to be located correctly in the holder. In general we may say there is preferably 3-8 divider walls, preferably 4-6.

The holder is generally a plastics body, rigid and substantial, but the article, once the dosage elements have gone, is light and may even be rather flimsy. It suitably comprises just the backing material and the sleeves (which may be light thermoformed sheet, or film). The article is intended as a refill, the holder retained. The wastage of material when the article is exhausted is very small. The invention may thus be seen as a desirably ergonomic solution.

In this first aspect of the invention the holder is not part of the invention. In accordance with a second aspect of the invention there is provided a multiple dosing ware washing product comprising an article as defined above, in nested form, retained within a holder as described above.

Preferably the holder has means for retaining it releasably within a ware washing machine. For example it may have a hook to enable it to be hung from a rack of a dishwasher; or a clamp to enable it to be clamped to a rack of a dishwasher; or be designed to be fitted into a compartment of a rack of a dishwasher; or may have means allowing it to be releasably fitted to the wall of a dishwasher or laundry washing machine, or to the window of a laundry washing machine.

Preferably the holder has a lid adapted to deliver water to a selected dosage element. Preferably the holder has means to deliver water to the dosage elements in sequence, one in each wash. Such means may operate automatically or be operated by the user, before a wash is commenced.

In accordance with a third aspect of the invention there is provided a method of making an article in accordance with the first aspect, comprising forming a tray comprising a rack of cavities, introducing cleaning composition into the cavities, and sealing the cavities with said backing sheet, and forming the article into said nested form.

The tray may be of a plastics material and is preferably formed by a moulding process; preferably thermoforming.

The cleaning composition may be cast into the cavities or introduced into the cavities as already-formed dosage elements. They may suitably be formed by injection moulding or extrusion.

The cleaning composition may be introduced into the cavities by any suitable method, e.g. by fully or semi-automatic process or even manually. If the backing material is on the inside of the nested form of the rack comprising the solid dosage elements so that the dosage elements project outwards, the dosage elements may be maintained in nested form by any suitable means e.g. adhesive, elastic bands etc.

In accordance with a fourth aspect of the invention there is provided a method of carrying out washing in a ware washing machine, the method comprising inserting an article of the first aspect containing a plurality X of dosage elements into a said holder, operating the ware washing machine for X cycles, removing the spent article, inserting a new article, and operating the ware washing machine for further cycles.

In accordance with a fifth aspect of the invention there is provided the use of an article in accordance with the first aspect or of a multiple dosing ware washing product in accordance with the second aspect, in carrying out washing in a ware washing machine.

The invention will now be further described, by way of example, with reference to the accompanying drawings, in which.

Figure 1:
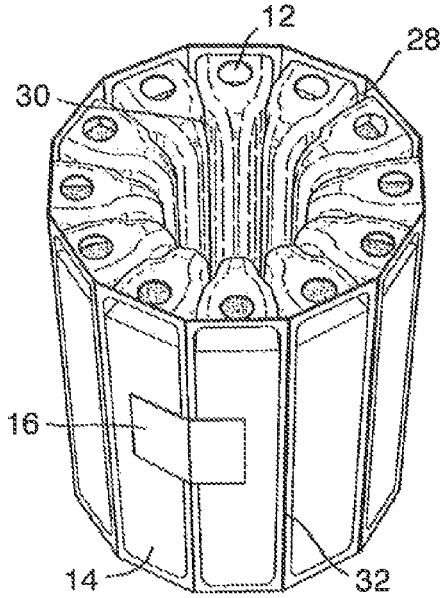
FIG. 1 shows an article of the present invention in nested form, in a perspective view, generally from above.
Figure 5A:
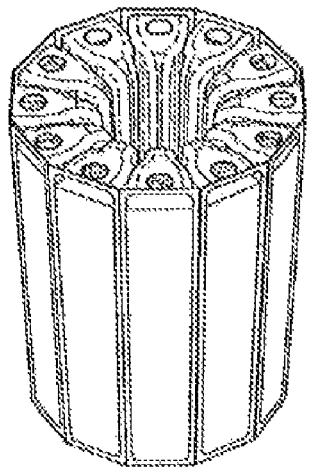
Figure 5B:
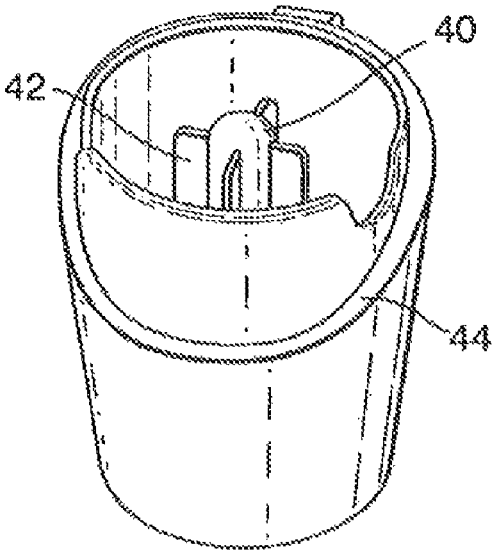
Figure 5C:
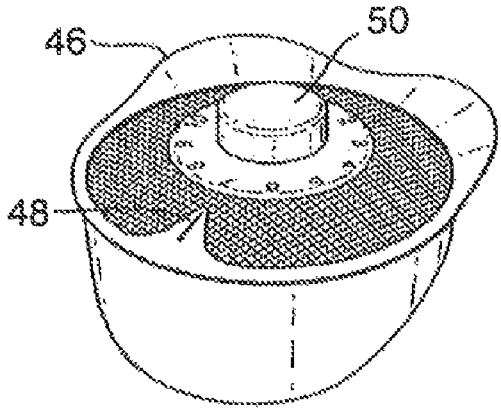

FIG. 5*a* shows the article of FIG. 1 being introduced into a holder of FIG. 5*b*, the cap, containing the dosage element selecting device, being she removed, as FIG. 5*c;*

Figure 6:
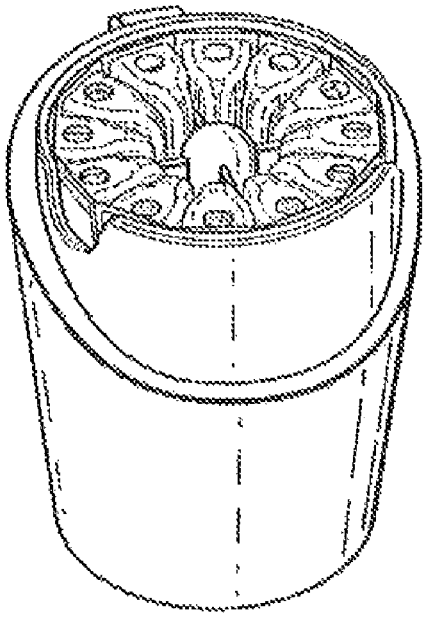
Figure 7:
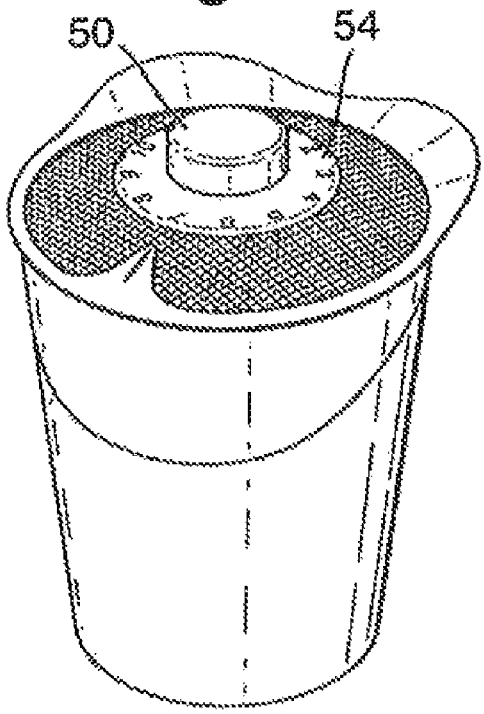

FIG. 6 shows the article of FIG. 1 having been located within the holder of FIG. 5*b*; and FIG. 7 shows the fully assembled device, with the cap of FIG. 5*c* having been placed on the holder and article assembly of FIG. 6.

Figure 2:
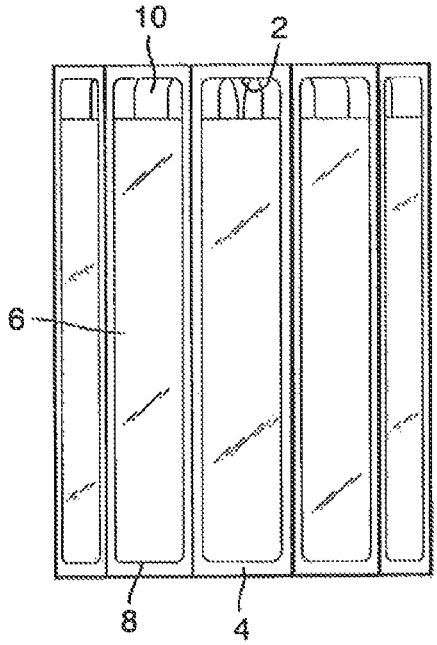
FIG. 2 shows the article of FIG. 1 in nested form, in side view.
Figure 3:
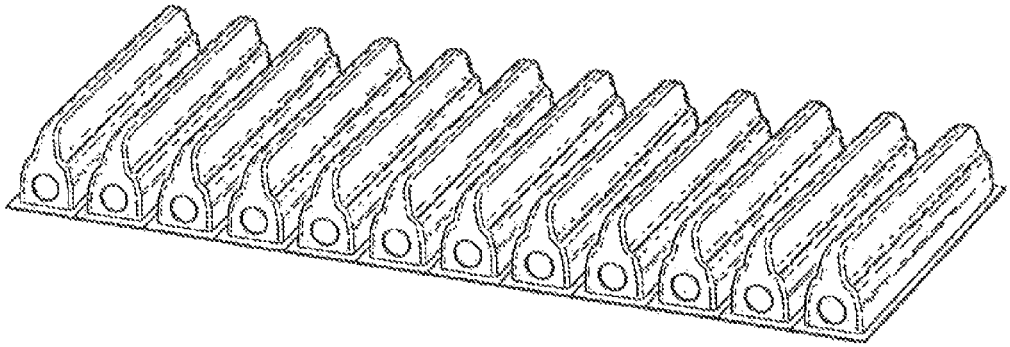
FIG. 3 shows the article of FIG. 1 in flat form.

The article of FIG. 1 is manufactured as a flat plastics tray of elongated blister pockets 2, shown in FIG. 3, comprising a thermoformed plastics tray. The open end of each blister pocket 2 is formed all around its perimeter with an endless flange 4 (which can be seen in FIG. 2). Solid rods or sticks of a cleaning composition 6 (intended in this embodiment to be used for cleaning in an automatic dishwasher machine) are introduced into the blister pockets. This can be done in different ways. For example in one embodiment the cleaning composition can be injected or cast into the pockets. However in this embodiment the rods or sticks are pre-formed by injection moulding or extrusion, then cut to length, then introduced into the pockets. It may be noted that they are introduced into the pockets to fill each pocket to the bottom end 8, but to leave a space 10 at the top end. This space 10 is left so that water can enter the pocket, via opening 12 in the upper end wall of the pocket. In this embodiment each such opening 12 is circular, and 8 mm in diameter. An identical opening (not shown) is formed in the lower end wall of the article, to allow water and entrained or dissolved cleaning composition to exit the pocket.

The physical parameters of each rod or stick are as follows

Length: 80 mm

Thickness (maximum value): 22 mm

Cross-sectional area: 2 $cm^2$

Surface area: 40 $cm^2$

Weight: 18.5 g

Volume: 14.8 $cm^3$.

Once all of the pockets have been provided with the rods or sticks of cleaning composition (by whatever means) a backing sheet 14 is laid over the open ends, and secured to the flanges 4. The backing may be adhered thereto by any convenient means, for example by heat or adhesive.

Next, the flat article, now in the form of a rack or linear array of rods or sticks, may be curled into its nested form shown in FIG. 1. In this embodiment the nested form is a generally cylindrical array. It may be retained in its nested form by a piece of adhesive tape 16.

The backing may be printed on its outwards-facing side with information, for example a trade mark, with product get-up, and/or with usage information.

Figure 4:
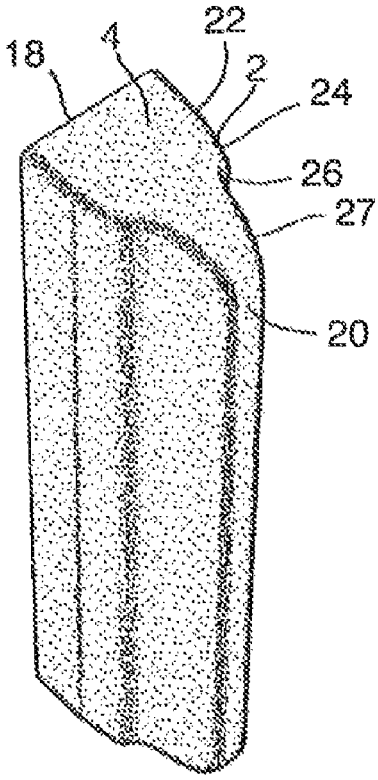
FIG. 4 shows the dosage element of FIG. 3 in plan view.

As shown in FIG. 4, each rod or stick—and correspondingly each blister, has a flat base wall 18 abutting the backing sheet 14. From the base wall 18, each rod or stick, and each blister, generally tapers to a narrower distal end wall 20. The side walls initially taper gradually, as at 22, 24, then undergo a somewhat abrupt inward dislocation 26, then taper at an intermediate rate (between that of the side wall portion 22 and the dislocation 26) at 27, until the distal end wall 20 is reached.

The rods or sticks may be regarded as having the general shape of a triangular prism (i.e. trigonal). To be more precise, as noted above the side walls taper in a discontinuous manner.

It will be noted that the rods or sticks are located on the backing sheet with a separation 28 between them, at their base walls 18.

It may further be noted that the rods or sticks have a separation 30 between them, at their distal end region, when in their nested form.

The backing sheet has, as a result of the mould into which it is thermoformed during manufacture, preferential fold lines 32. These fold lines 32 are aligned with the spacings 28 between the rods or sticks.

The end result of these features is as follows, and can be clearly seen in FIG. 1: when the article is formed into its nested shape the backing sheet is displaced about its fold lines 22, in an articulated manner. This nesting or folding is permitted by the spacings 28 and 30; the sticks or rods simply abutted against each other the operation would not be permitted, due to physical obstruction. As can be seen in FIG. 1 the spacings 30 in the distal end regions may remain even in the nested form (though obviously narrowed).

In use, the article of the invention is a refill which is supplied in its nested form shown in FIG. 1, and also FIG. 5*a*. In that nested from it is inserted into a holder, shown in FIG. 5*b*. The holder is a cylindrical tub having a hub-like axial projection 40 extending upwards from its base substantially the whole axial length of the tub. Projecting outwardly from the projection 40 are four fins 42, set at 90° intervals. The fins extend approximately four-tenths of the radial distance of the holder.

The holder has a hanging handle 44.

The bottom wall of the holder is a large opening (not shown).

The holder has a lid shown in FIG. 5*c*. The lid has a central indexing device 46 surrounded by a sieve 48, to allow particulate-free water to enter the holder. The central indexing device has a push button 50 and, around it, a dial 54 carrying numbers, equaling the number of rods or sticks of cleaning composition. Each time the dishwasher is to be used, the user presses the button to advance the control dial by one number, bringing the next rod or stick of cleaning into use. This is done by rotating an apertured disc within the lid by one position so that water entering the holder must pass through the aperture thereof, now in alignment with the next rod or stick. Water enters the appropriate blister through the opening 12 which is aligned with the opening within the lid. The water may fill the spacing 10 above the rod or stick. The rod or stick is soaked by the water and dissolves and/or crumbles away, leaving the blister through the bottom opening.

Somewhat surprisingly, we have found that excellent dissolution of the rods or sticks is achieved by this method. It might have been expected that dissolving dosage elements of the cleaning composition by directing water to one end of them in an axial or lengthwise direction might be an inefficient method. In fact, dissolution or dispersion is excellent and the arrangement is very space-efficient, in not taking up very much of the "footprint area" available within the dishwashing machine.

As can be seen in FIG. 6, when the article is located within the tub of the holder the fins 42 are located within spacings 30 of the nested article. The tolerance of the fins in the spacings 30 is not large and in this way it is assured, that the rods or sticks, and the upper openings 12, are in the correct orientation, to align with the opening within the lid.

FIG. 7 shows the fully assembled device.

The invention claimed is:

1. A multiple dosing ware washing article which comprises a rack of solid dosage elements of a cleaning composition, wherein the article comprises sleeves to retain the dosage elements, the sleeves being formed by a molded or thermoformed tray, with sleeves into which the dosage elements are placed, and each of the sleeves containing said solid dosage elements being closed by a backing material, each sleeve has two openings at opposite ends so that water may enter one end and leave the other end carrying with it dissolved or broken away cleaning composition, wherein in the article there is gap between dosage elements in a non-nested position sufficient to allow the article to be formed into a nested position without hindrance between the dosage elements; and preferably such that, in its nested form, at least the distal ends of each pair of dosage elements are separated by a spacing, the rack of dosage elements being in nested form, which article is adapted to be retained as a refill within a holder, located in use in a dishwashing machine.

2. A article as claimed in claim 1 wherein the holder has a hub from which radiates an array of fins, in number preferably from 3 up to the number of dosage elements within the article.

3. A article according to claim 1 wherein the holder has a hook or a clamp for retaining it releasably within a ware washing machine.

4. A article according to claim 1 wherein the holder has a lid adapted to deliver water to a selected dosage element.

5. A multiple dosing ware washing article according to claim 1, wherein the dosage elements of the article are in the form of rods or sticks.

6. A multiple dosing ware washing article according to claim 1 wherein the article in the nested form, is configured such that the backing material is on the outside of the article and the dosage elements project inwardly.

7. A multiple dosing ware washing article according to claim 1 wherein the article comprises from 6 to 20 dosage elements.

8. A method of making a multiple dosing ware washing article according to claim 1 comprising: forming a tray comprising a rack of sleeves, introducing cleaning composition into the sleeves, and sealing the sleeves with said backing sheet, and forming the article into said nested form.

9. A method of washing wares in a ware washing machine, the method comprising the steps of:

inserting a multiple dosing ware washing article according to claim 8 into said holder, operating the ware washing machine for a plurality of cycles, removing the article after all the dosage elements within the article are spent, thereafter inserting another multiple dosing ware washing article according to claim 8, and subsequently operating the ware washing machine.

* * * * *